US005725118A

United States Patent [19]

Slager et al.

[11] Patent Number: 5,725,118

[45] Date of Patent: Mar. 10, 1998

[54] MODULAR SIDE-LOADING CONTAINER SYSTEM

[75] Inventors: Charles L. Slager, Hudsonville; William J. Vroon, Holland; Brian E. Bouwens, Hudsonville, all of Mich.

[73] Assignee: Bradford Company, Holland, Mich.

[21] Appl. No.: 631,060

[22] Filed: Apr. 12, 1996

[51] Int. Cl.[6] ..... B65D 85/00

[52] U.S. Cl. ..... 220/4.28; 220/1.5; 220/504; 220/507

[58] Field of Search ..... 220/4.28, 1.5, 220/504, 507, 528, 453

[56] References Cited

U.S. PATENT DOCUMENTS

| | | | |
|---|---|---|---|
| D. 217,232 | 4/1970 | Meller et al. . | |
| 1,581,689 | 4/1926 | Perin . | |
| 1,765,591 | 6/1930 | Kellett . | |
| 3,338,405 | 8/1967 | Hadenka et al. . | |
| 3,438,343 | 4/1969 | McConnell . | |
| 3,499,694 | 3/1970 | Coppel | 220/1.5 X |
| 3,968,895 | 7/1976 | Barnes, Jr. et al. . | |
| 4,247,245 | 1/1981 | Stolt et al. | 220/1.5 X |
| 4,377,241 | 3/1983 | Schreiner . | |
| 5,045,369 | 9/1991 | Kobayashi et al. | 220/453 X |
| 5,086,920 | 2/1992 | Binienda | 220/1.5 X |
| 5,263,701 | 11/1993 | Kleinhen | 220/4.28 X |
| 5,289,940 | 3/1994 | Wisenbaugh | 220/504 X |
| 5,323,911 | 6/1994 | Johnston, et al. | 220/507 X |
| 5,324,105 | 6/1994 | Christensen . | |
| 5,377,856 | 1/1995 | Brierton . | |
| 5,395,682 | 3/1995 | Holland et al. . | |
| 5,415,310 | 5/1995 | Simms | 220/4.28 |

*Primary Examiner*—Steven M. Pollard
*Attorney, Agent, or Firm*—Wood, Herron & Evans, LLP

[57] ABSTRACT

A container for holding product therein during shipment and comprises a body including a base, rigid side walls and a removable cover. The body has at least one open side and a first product grid is positioned in the body and forms a first plurality of generally horizontally disposed product bins. The product bins have outside open ends and are disposed such that the outside open ends face outwardly of an open side of the container for horizontally receiving a product to be shipped and for providing horizontal access to the product from a side of the container. A second plurality of bins is juxtaposed with the first plurality and flexible wall is positioned between the two bin pluralities to form end walls for the bins. The flexible end walls create an expansible bin. The container body also includes a mounting structure thereon for securing at least one additional rigid side wall to the body for forming a container body closed on all sides. The container provides horizontal access to the products therein and is retrofittable into a container which is accessed vertically.

23 Claims, 4 Drawing Sheets

MODULAR SIDE-LOADING CONTAINER SYSTEM

FIELD OF THE INVENTION

The present invention relates generally to shipping containers used to ship products, and more specifically to a lightweight, durable and multipurpose container which may be accessed from the side on an assembly line.

BACKGROUND OF THE INVENTION

A large number of different container structures are utilized by manufacturers to ship a variety of different products to end users, which may be, for example, assembly plants. In the automobile industry for example, an assembly plant assembling a particular automobile might utilize a number of different parts manufacturers. These manufacturers ship their respective parts to the assembly plant in container structures where the parts are then assembled together into a finished automobile.

For a variety of automobile parts, and particularly large or long parts, such as door panels, steel rack structures or racks are often used for shipment. Such steel racks generally comprise an open steel frame which contains the parts and provides sufficient structural support during shipment to reduce or eliminate any damage to the parts. The steel racks are specially designed and dimensioned for a particular automobile part and the racks support the parts in a side-by-side fashion for easy access on an assembly line. For example, a steel rack full of parts will usually be positioned next to a particular station on an assembly line, and the line worker will remove the part directly from the rack for installation on the automobile. For easy access, the racks are often designed to be entered from the side so that the parts are removed horizontally rather than vertically as with some other containers. Horizontal removal of parts facilitates an easier transition to the assembly line for the worker who has to install the part.

While steel racks have proven adequate for parts shipment, such racks also have various drawbacks. First, the steel racks are heavy, which makes shipping and handling more difficult, dangerous, and expensive. Furthermore, the steel racks themselves are expensive to fabricate, and generally must be specially fabricated and fitted to hold the specific parts being shipped. They are then only adequate for containing a single part type.

Steel racks generally comprise an open frame and specially designed support structures within the frame for engaging the frame and the product simultaneously to support the product within the frame during shipment. As a result, a steel rack used for one part, may not be readily adaptable to be reused with another different part. Therefore, existing steel racks do not provide a great amount of flexibility for the purposes of reuse. Thus the overall cost of the rack remains high, because reuse is not often a viable option, except for one specific part. If that part is obsolete or no longer needed, the rack may essentially be worthless.

Another drawback to steel racks is the amount of time that is usually necessary for delivery of a special rack from the manufacturer, once a particular size, style and configuration of rack for a particular part is chosen. Such delays in the delivery schedule, which may be in the range of 8–10 weeks, amount to substantial delivery delays when shipping parts. Shipping delays also increase the overall costs of using a steel rack to ship a product.

Disposal of empty racks is also a problem since generally they are not reused for other parts due to their specialized construction. Steel racks are susceptible to rust if left in moist conditions for any length of time. Therefore, a stored rack may be aesthetically unattractive even if it is eventually reused.

An additional drawback with steel racks is that they are not fabricated with particularly close tolerances. Whenever any additional support or dunnage materials are added to the steel rack, it is often difficult to arrive at standard dimensions for the dunnage because of the variations in the tolerances of the rack.

Accordingly, it is an objective of the invention to address the drawbacks of conventional steel racks and to provide a shipping container that is easily accessible on an assembly line to facilitate the transition from container to automobile for a line worker.

It is another objective to provide a shipping container which is less expensive to manufacture than a traditional steel rack and which provides greater flexibility for reuse.

It is still another objective of the invention to provide a lightweight container which is durable and not susceptible to rust or erosion.

It is still another objective to provide a container which may be used and reused for shipping a variety of different parts.

It is still another objective to provide storage and containment of parts with horizontal access for a line worker.

It is still another objective of the invention to provide a containment system which may be tailored for shipping a particular part, but which is ready for delivery and use in a relatively short amount of time for reducing shipping delays.

SUMMARY OF THE INVENTION

The present invention addresses the above objectives and other objectives and addresses the drawbacks and the prior art by providing a container which holds products therein during shipment and is horizontally accessible, such as on an assembly line, for rapid access to the product in the container. In addition, the container is retrofittable to provide a shipping container having four solid side walls and vertical access through a top opening.

To that end, the container of the present invention comprises a body including a rigid base, rigid side walls coupled to the base and extending upwardly therefrom and a removable cover resting on the upper edges of the side walls. The container has at least one open side which is not enclosed by a rigid side wall. A product grid is positioned in the body and comprises a plurality of vertically oriented support walls and a plurality of horizontally oriented support walls which are operably interconnected together to form a plurality of horizontally disposed product bins. The bins are open at both ends and are positioned in the container body such that one of the open ends of each bin faces outwardly of an open side of the container body to receive a product.

In one embodiment of the invention, two separate product grids are positioned in the container body such that two pluralities of bins are juxtaposed with each other. Outside open ends of one plurality of bins face outwardly of one open side of the container body while outside open ends of the other plurality of bins face outwardly of an opposite open side of the body. The inside open ends of the juxtaposed pluralities of bins are then adjacent to each other toward the middle of the container. Preferably, the various bins are configured such that the two pluralities abut and form coextensive, horizontally disposed bins. A flexible internal wall structure, such as a wall of an abrasion-resistant cloth material, is positioned between the juxtaposed pluralities of bins to form a flexible end wall for each of the bins. In that way, a product having a length greater than the length of the bin may be positioned in the bin with the flexible internal wall providing the necessary amount of give for proper containment. The flexible internal wall separates the coextensive bins and allows nesting of the parts wherein the flexible internal wall gives in one direction for one bin and gives in the other direction for the opposite bin.

In an alternative embodiment of the invention, the container body comprises three rigid side walls and has one side which is open. The product bins extend generally the length of the container body with one of the container body rigid side walls providing the end wall for the plurality of bins. The open ends of the bins face outwardly of the open side of the container.

A flexible side wall is removably mounted to the container body at each open side of the body and covers the outwardly facing open ends of the horizontal bins to effectively close the bins and contain the product, such as automobile parts, therein for shipment. As may be appreciated, the embodiment of the invention utilizing two juxtaposed pluralities of bins will have two such flexible side walls to provide access from two different sides of the container, whereas the embodiment having only a single plurality of bins will only utilize one flexible side wall.

In accordance with the principles of the present invention, the product support grid forming the horizontal product bins is removable from the container body, such as by removing the cover and lifting the support grid out of the container body. The rigid base includes a mounting structure thereon along the open side of the container for receiving an additional rigid side wall to form a container having four rigid vertical side walls. Upon removal of the horizontal product bins, the container of the invention is a vertically accessible rigid container and may be reused to ship other products which would then be accessed through the top of the container after the cover has been removed. In that way, the container is multi-purpose and may be continuously reused when horizontal access is no longer necessary, such as when different parts are shipped in the container. If horizontal access is again desirable, one or more of the rigid side walls is removed, and the product grid is positioned to form horizontally accessible product bins.

The body of the container, including the side walls, is preferably made of injection molded plastic and the vertically and horizontally oriented support walls making up the product support grid are a plastic tri-laminate construction wherein two plastic laminate panels have a bubbled plastic medium therebetween. Preferably, the panels and medium are polypropylene or polyethylene. The invention may be utilized to ship elongated automobile parts normally requiring a steel rack, and horizontal access is provided for rapid part transition from container to assembly line. The container is relatively inexpensive to manufacture. Furthermore, the container is very light compared to a steel rack, thus easing the burden and costs of shipping and handling. Additionally, the container may be constructed relatively quickly for a large variety of products having various different dimensions. The container of the present invention may be fabricated with close and consistent tolerances thereby assuring that the product grid of one container might be used with another container of a similar design and will be held securely therein. Therefore, a finished container may be produced for a customer on a delivery schedule significantly shorter than those required for conventional steel racks. The invention is durable and generally rust free because of its plastic construction. Therefore, the container will maintain an aesthetically pleasing look despite continued reuse.

The above and other advantages of the present invention shall be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
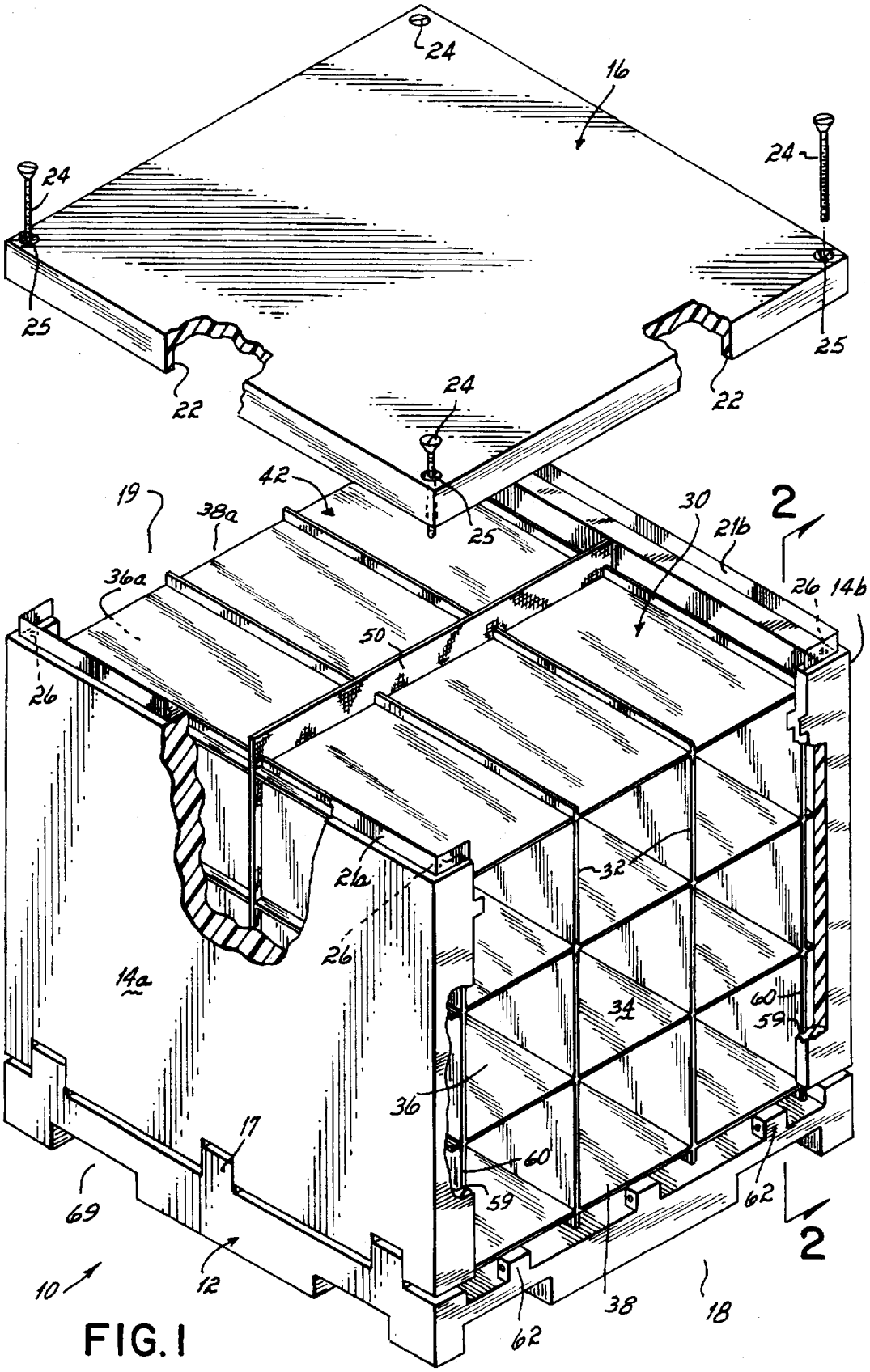
FIG. 1 is a perspective view, partially cut away, of a container constructed in accordance with the principles of the present invention.

FIG. 1 illustrates a container 10 constructed in accordance with the principles of the present. Container 10 comprises a body including a rigid base 12, rigid side walls 14*a*, 14*b* and a removable cover 16. The rigid side walls 14*a*, 14*b* are coupled to the base 12, such as with hinge structures 17 and extend vertically upwardly from the base to form closed sides of the container body. The container 10 illustrated in FIG. 1 has two opposing closed sides indicated by rigid sidewalls 14*a* and 14*b* and two opposing open sides 18, 19. The open sides 18, 19 provide horizontal access into the body of container 10 in accordance with the principles of the present invention as discussed further hereinbelow.

The upper edges of the side walls 14*a*, 14*b* include vertically upstanding lips 21*a*, 21*b*. The upstanding lips are received within the removable cover 16 which has a downwardly extending lip 22. When the removable cover 16 is placed on the upper edges of the side walls 14*a*, 14*b* the corresponding lip structures 21*a*, 21*b* and 22 abut one another to keep the removable cover 16 from shifting around on the top of the container body. The removable cover 16 may be more permanently secured to the container body, such as by bolts 24 which extend through appropriate openings 25 in the cover 16. When the cover 16 is placed on the upper edges of the side walls 14*a*, 14*b*, the bolts extend into openings 26 in the side walls which align with the openings 25 in the cover. For one use of the container 10 of the present invention, the removable cover 16 will be rigidly mounted to the side walls 14*a*, 14*b* of the container such as with bolts 24. However, in another configuration of the present invention, the bolts 24 will not be utilized so that cover 16 may be more readily removed from the container body to provide access to the container body from the top thereof.

Container 10 further comprises a first product grid 30 which is positioned inside the container body. The product grid 30 comprises a plurality of generally vertically oriented support walls 32 and a plurality of generally horizontally oriented support walls 34 which are operably interconnected together, such as in a cross-pattern as shown, to form a plurality of generally horizontally disposed product bins 36.

Figure 2:
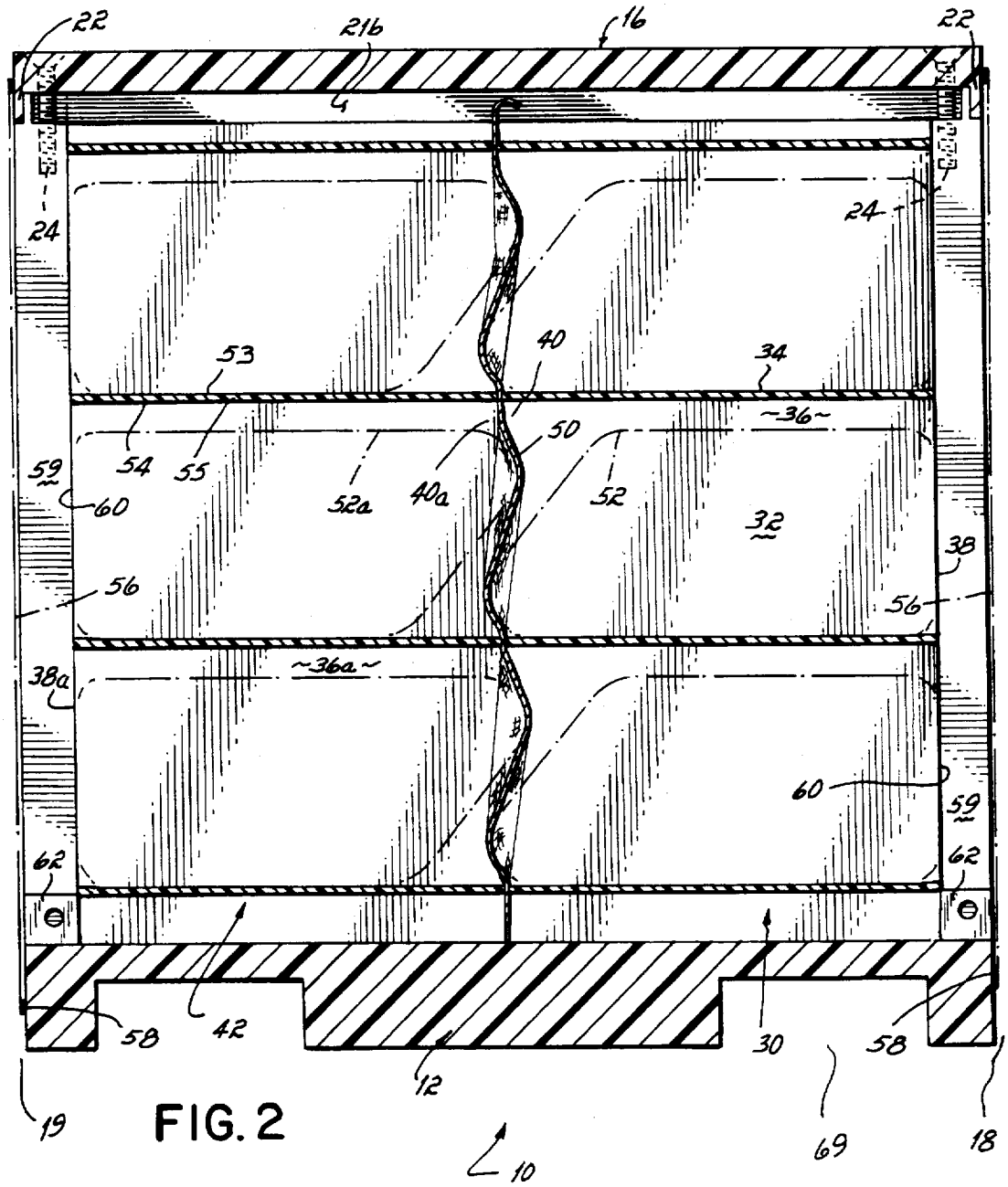
FIG. 2 is a sectional view taken along lines 2—2 of FIG. 1 illustrating the flexible internal wall structure of the present invention.

Referring to FIG. 2, the product bins are open ended and have an outside open end 38 and an inside open end 40. As illustrated in FIG. 1, the horizontally disposed product bins 36 are positioned in the container body such that the outside open ends 38 face outwardly of the open side 18 of container 10. In that way, the product bins 36 are disposed for horizontally receiving a product to be shipped and also for providing horizontal access to the product from an open side 18 of the container. The product bin inside ends 40 face inwardly generally toward the center of the container body (see FIG. 2).

In the embodiment of the invention illustrated in FIG. 1, a second product grid 42 is positioned in the container body juxtaposed with the first product grid 30. Second product grid 42 is preferably formed similarly to grid 30 and also includes a plurality of horizontally disposed product bins 36*a* which have outside open ends 38*a* and inside open ends 40*a*. The first product grid 30 is juxtaposed with the second product grid 42 in the body of container 10 such that the inside open ends 40, 40*a* of the respective product bins 36, 36*a* are adjacent to one another. Preferably, the product grids 30, 42 are similarly constructed and dimensioned such that when they are juxtaposed in the container body, the respective horizontal product bins 36, 36*a* are aligned in a coextensive or end-to-end relationship as illustrated in FIG. 2.

Container 10 of the invention further comprises a flexible internal wall structure or wall 50 which divides the respective product grids 30, 42. Referring to FIG. 2, internal wall 50 extends generally vertically between the respective product bins 36, 36*a* and thereby defines a flexible end wall for closing the inside open ends 40, 40*a* of the respective product bins 36, 36*a*. Flexible end wall 50 in conjunction with the vertically disposed walls 32 and horizontally disposed walls 34 function to contain product 52 placed within the product bins 36, 36*a*. The flexible inside end wall 50 provides an amount of give within each product bin 36, 36*a* so that a product bin may receive a product 52, such as an automobile part, which is dimensioned in length longer then the length of the product bin.

As illustrated in FIG. 2, the long product 52 then simply distorts or flexes the end wall 50 so that product 52 fits within the product bin 36. The products 52*a* within the product bin 36*a* may be flipped 180° to provide an indentation in the end wall 50 in a direction opposite the indentation produced by product 52. That is, the flexible end wall 50 gives or flexes in one direction at the bottom of a bin 36 for receiving product 52, and then flexes at the top of coextensive bin 36*a* for receiving product 52*a*. In that way, the products 52, 52*a* in any two coextensive product bins will slight nest together as provided by the flexible end wall 50.

The product 52, 52*a* is shipped within the container 10 of the present invention and is horizontally arranged to be horizontally retrieved from container 10. For example, container 10 may be positioned proximate a station on an assembly line with one of the open sides 18 or 19 of the container facing an assembly line worker. The worker then simply has to reach horizontally and pull the product out of a particular product bin. As may be appreciated, each of the products will be individually contained within its respective product bin and therefore the product may be removed without interfering with any other adjacent products. Furthermore, the horizontal disposition of each of the products provides for a smooth product transition between container and installation on an assembly line. Still further, the assembly line worker will be able to tell at a glance exactly how many parts remain within the container 10 before a new container full of parts will be needed.

Figure 3:
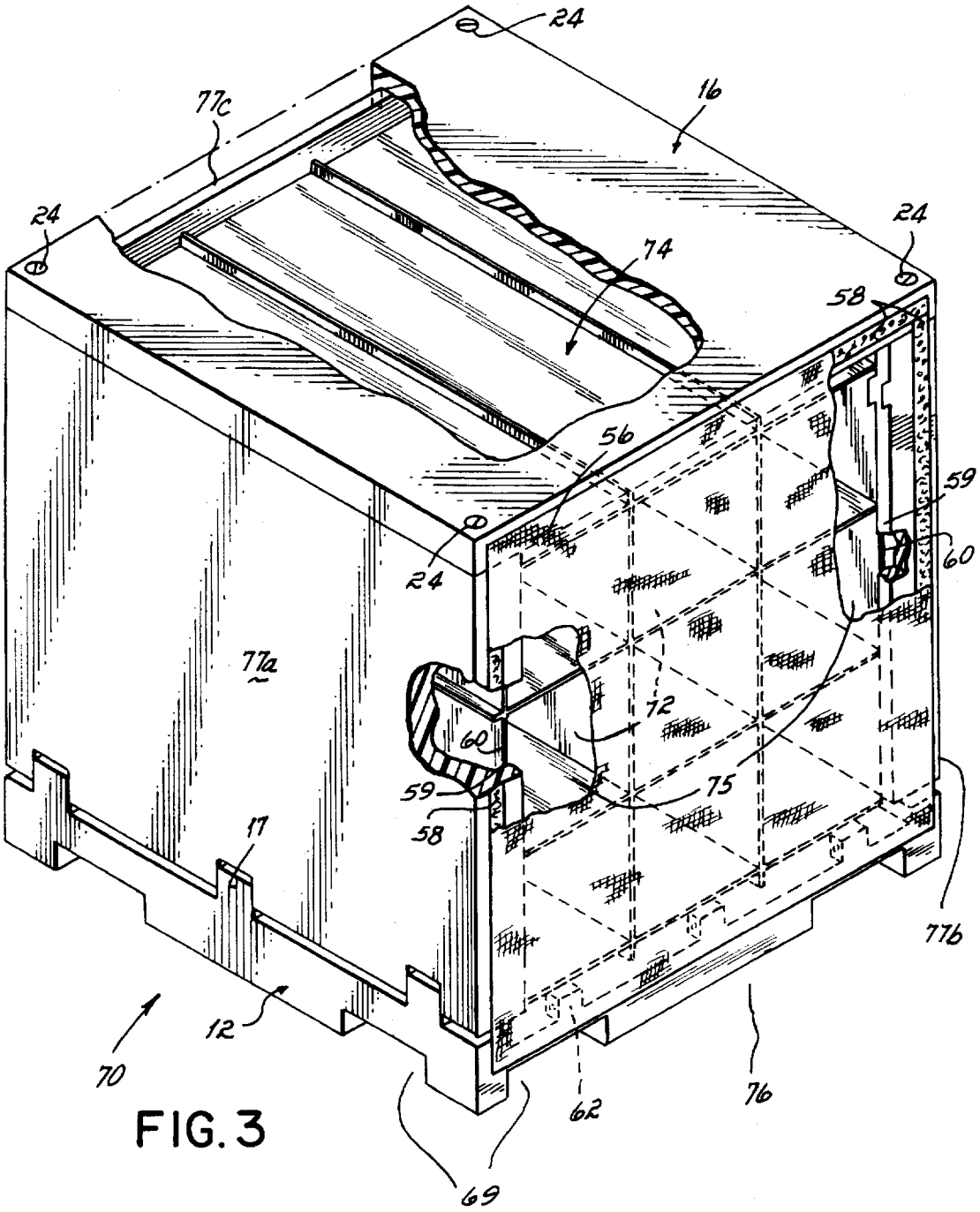
FIG. 3 is a perspective view of an alternative embodiment of a container constructed in accordance with the principles of the present invention.

To contain the products 52, 52*a* within the respective product bin 36, 36*a* during shipping, the present invention further comprises a flexible side wall structure 56 for covering the open side and thereby closing the outside open ends 38, 38*a* of the product bins 36, 36*a*. Referring to FIG. 3, the flexible side wall structure 56 is preferably a durable cloth material which is abrasion resistant and is able to withstand the rigors of shipment. The flexible sidewalls structure is secured to the container body by appropriate releasable fastening structures, such as Velcro strips 58. Other releasable fasteners might also be utilized, such as snaps or clip structures (not shown). When container 10 is shipped, all of the sides are closed with two of the sides being closed by the rigid side walls 14*a*, 14*b* and the normally opened sides being temporarily closed by the flexible side wall structures 56.

When the parts arrive at the assembly plant and are properly positioned on the assembly line, the flexible side wall structure 56 may be removed to provide open horizontal access to the product bins 36, 36*a*. While the flexible side wall structure 56 is illustrated as a continuous rectangular piece in FIG. 3, the side wall structure might also be a cloth, grid or even a net structure to temporarily close the outside open ends 38, 38*a* of the product bins.

The body of container 10, including the base 12, side walls 14*a*, 14*b* and removable cover 16 are formed of plastic such as an injection molded plastic. Therefore, container 10 is very lightweight compared to steel racks and is much more inexpensively fabricated then a specialized steel rack.

The product grids 30, 42 are preferably fabricated of a plastic composite material such as polyethylene or polypropylene. In one embodiment of the invention, the generally horizontally oriented support walls and the generally vertically oriented support walls are a triple laminate or trilaminate construction comprising a first laminate layer 53, second laminate layer 54 and a bubbled plastic medium 55 therebetween. Such a triple laminate construction provides rigidity and strength while being lightweight, which is a significant advantage of the present invention over conventional heavy steel racks.

The product grids 30, 42 of the present invention may be readily configured and dimensioned for a number of different automobile parts. Therefore, the container 10 of the invention may be specially designed and manufactured for a particular automobile part and may then be delivered to the customer at a relatively rapid turnaround rate from order to delivery. Conventional steel racks take a long time to fabricate and generally may not be ready for delivery until 8–10 weeks after they are ordered. The present invention addresses such drawbacks of steel racks and thereby reduces shipping delays which result from the delays in receiving a finished steel rack.

In accordance with the principles of the present invention, the product grids 30, 42 are positioned in the container body and are held therein by the side walls 14*a*, 14*b* and the base 12 and cover 16. Referring to FIG. 1, the corners of each of the side walls 14*a*, 14*b* have wrap around segments with lateral edges 59 which engage adjacent grid portions 60 to laterally contain the product grids 30, 42 and prevent them from shifting within the container body in the direction of the open sides 18, 19. The product grids 30, 42 are further contained at the top and bottom by the base 12 and the cover 16. The container body of the invention may be fabricated with close and consistent tolerances. Therefore, a product grid built for one container may be interchangeably used in another similarly constructed container. The interchangeable product grids further add to the flexibility of the container of the present invention and eliminates the necessity of having to specifically tailor each product grid for each individual container.

Figure 4:
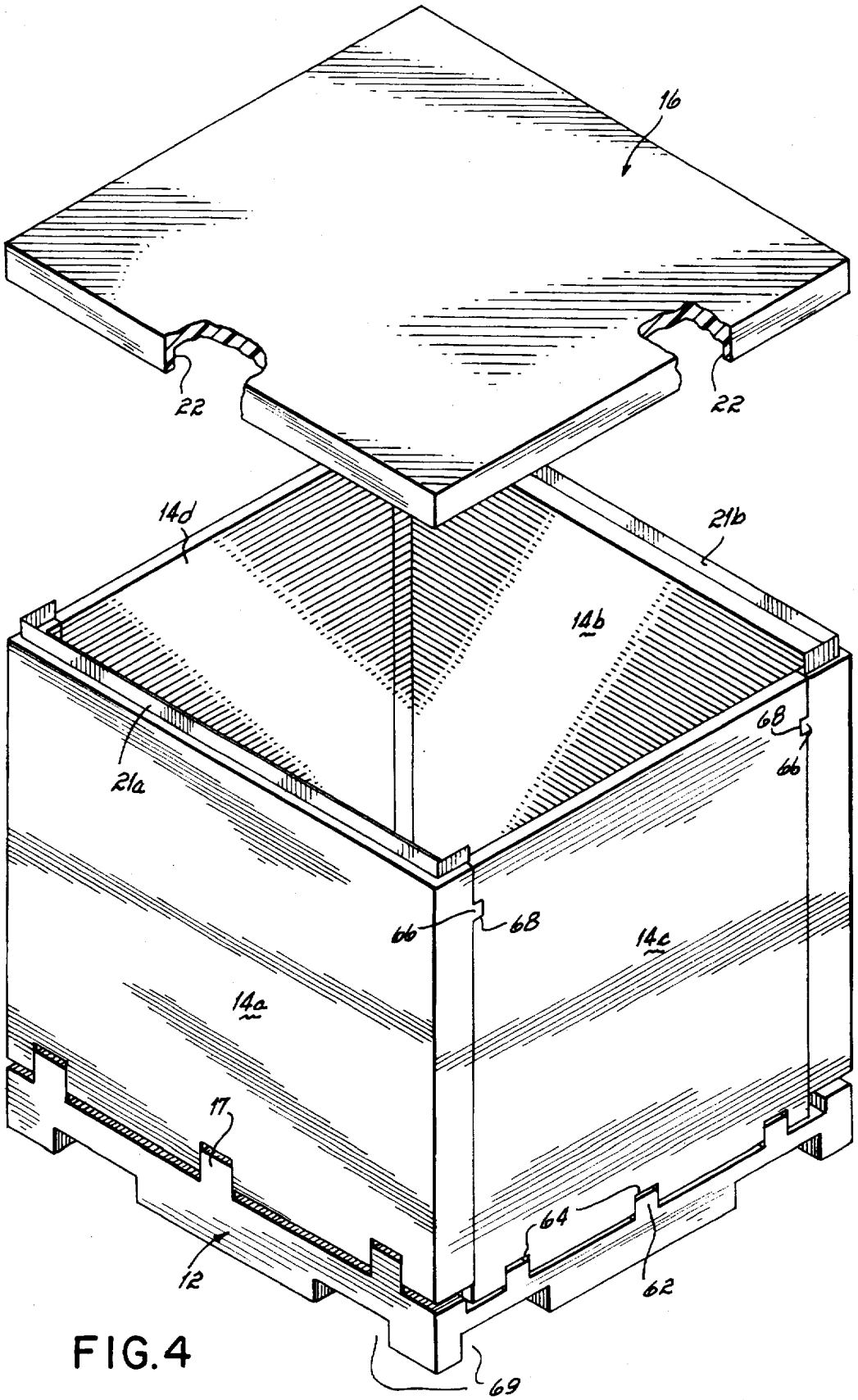
FIG. 4 is a perspective view of the container of the invention retrofitted with rigid side walls to provide a completely enclosed container.

In accordance with the principles of the present invention, the container 10 may be retrofitted for a different use, such as when horizontal access is no longer necessary. To that end, base 12 further includes a mounting structure thereon such as hinge structures 62 for securing additional rigid side walls to base 12 for forming a container body closed on all sides. Referring to FIG. 4, side walls 14*c* and 14*d* may be added. In that way, a rigid four-sided container is presented, which may be opened and accessed from the top by removing cover 16. Thus, the invention is capable of multiple uses and reuses providing access both horizontally through bins 36, 36*a* and vertically through the top of the container body after the bins 36, 36*a* are removed. This addresses a significant drawback in steel racks which generally are suited for a single purpose and a single automobile part. When the particular part is no longer needed, the steel racks are not very useful.

In order to retrofit container 10 of the present invention and provide a rigid, four-sided, vertically-accessible container, the product grids 30, 42 are removed from the container body and two opposing rigid side walls 14*c*, 14*d* are attached to the base at the open sides 18, 19 of the container body. The side walls 14*c*, 14*d* have mounting structures 64 which cooperate with the mounting structures 62 of the base 12 to secure the side walls to the base. As may be appreciated, mounting structures other than the hinge-type structures 62, 64 may be utilized to secure the side walls. The side walls 14*a*, 14*b* also preferably include latching structures 66 which cooperate with latching structures 68 on the other side walls 14*c*, 14*d* to further secure the side walls together to form the body of container 10.

Referring to FIG. 4, container 10 becomes a vertically-accessible rigid container which is often referred to as a pallet container or palletainer, due to the fact that base 12 generally resembles a shipping pallet and has forklift-receiving openings 69. Container 10 of the present invention significantly reduces the overall shipping costs of the container by providing a multi-purpose and multi-use container which may carry parts for horizontal access or vertical access.

Container 10 provides a more desirable alternative to conventional steel racks and is durable, lightweight and generally inexpensive to fabricate. When use of the horizontal product bins 36, 36*a* is no longer desirable, they can removed, and the container 10 may be retrofitted as illustrated in FIG. 4 to provide an erect palletainer with four rigid side walls. As a result, container 10 may be reused numerous times. After container 10 has been retrofitted, it may again be desirable to utilize it for containing and shipping horizontally disposed products. To that end, the side walls 14*c*, 14*d* may be removed and the product grids 30, 42 reinserted into the container to form the container shown in FIGS. 1 and 2. The lightweight container 10 is rigid enough to be stacked with other like containers in either version disclosed.

FIG. 3 illustrates an alternative embodiment of the invention, container 70 is constructed similarly to container 10; however, the product bins 72 are dimensioned to extend the entire length of container 70. Referring to FIG. 3, it may be seen that the product bin 72 are formed by a single product grid 74 positioned in the body of container 70. The open ends 75 of the bins face outwardly of an open side 76 of container 70. Side walls 77*a*, 77*b*, and 77*c* close the other sides of the container 70. Side wall 77*c* provides a rigid end wall for closing the other open ends the bins 72 opposite open ends 75. The product bins 72 are dimensioned in length to receive longer products than the product bins 36, 36*a* of container 10. To ship the products, the flexible side wall 56 is utilized to the close the open ends 75 as discussed above.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A container for holding product therein during shipment and providing ready access to the product, comprising:

a body including a base, at least two rigid side walls coupled to the base to extend vertically upwardly therefrom, and a removable cover positioned on upper edges of the side walls, the body having at least one open side;

a first product grid positioned in the body, the product grid comprising a plurality of generally vertically oriented support walls and a plurality of generally horizontally oriented support walls operably interconnected together and forming a first plurality of generally horizontally disposed product bins;

at least one of said product bins having an outside open end and being disposed such that the outside open end faces outwardly of an open side of the container for horizontally receiving a product to be shipped and for providing horizontal access to the product from a side of the container;

a flexible internal wall structure positioned at an inside open end of at least one of the product bins for forming a flexible end wall for the bin;

the container body including a mounting structure thereon for securing at least one additional rigid side wall to the body for forming a container body closed on all sides;

whereby the container provides horizontal access to the products therein and is retrofittable into a container which is accessed vertically.

2. The container of claim 1, further comprising a second product support grid positioned in the container body to provide a second plurality of generally horizontally disposed product bins wherein at least one of the bins has an outside open end which faces outwardly of an open side of the container.

3. The container of claim 2 wherein the bins from the first and second pluralities have outside open ends facing outwardly of opposite open sides of the body.

4. The container of claim 2 wherein the two product support grids abut one another in the container body such that inside open ends of at least two of the product bins are adjacent one another, the flexible wall structure being positioned between the adjacent inside open ends to form a flexible end wall for the adjacent bins.

5. The container of claim 1 wherein body of the container is formed of a plastic material.

6. The container of claim 1 further comprising a flexible side wall structure removably coupled to the container body for closing an outside open end of the product bin and containing a product therein.

7. The container of claim 1 wherein the flexible internal wall structure is a cloth material.

8. The container of claim 6 wherein the flexible side wall structure is a cloth material.

9. The container of claim 1 wherein the product bin includes an inside open end which abuts with a side wall of the container body, the side wall forming an end wall of the bin.

10. A container for holding product therein during shipment and providing ready access to the product, comprising:

a body including a base and at least two side walls coupled to the base to extend vertically upwardly therefrom, the body having at least one open side;

a first plurality of open-ended product bins disposed generally horizontally in the container body, each bin including an inside open end and an outside open end, at least one of said product bins having an outside open end facing outwardly of a first open side of the container for horizontally receiving a product to be shipped and for providing horizontal access to the product from a side of the container;

a second plurality of open-ended product bins disposed generally horizontally in the container body, at least one of said product bins having an outside open end facing outwardly of a second open side of the container opposite the first open side, the first and second pluralities of bins juxtaposed in the container body such that at least two of the bins from the pluralities have adjacent inside open ends;

a flexible internal wall structure positioned between the adjacent inside open ends to form a flexible end wall for the two bins such that the capacity of the bins may be expanded when product is placed therein.

11. The container of claim 10 wherein body of the container is formed of a plastic material.

12. The container of claim 10 further comprising a flexible side wall structure removably coupled to the container body for closing an outside open end of the produce bin and containing a product therein.

13. The container of claim 12 wherein the flexible side wall structure is a cloth material.

14. The container of claim 10 wherein the flexible internal wall structure is a cloth material.

15. The container of claim 10 wherein each of the bins of the first plurality has an open end facing outwardly of said first open side and each of the bins of the second plurality has an open end facing outwardly of said second open side.

16. The container of claim 15 wherein each bin of the first plurality is generally horizontally coextensive with a bin in the second plurality, the flexible internal wall structure forming the end walls for the bins and separating the coextensive bins.

17. The container of claim 10 wherein at least one of said pluralities of support bins comprises a plurality of generally vertically oriented support walls and a plurality of generally horizontally oriented support walls operably interconnected together to form said plurality of product bins.

18. The container of claim 17 wherein said support walls include a first laminate layer, a second laminate layer, and a fill medium positioned between the laminate layers.

19. The container of claim 18 wherein said laminate layers and said fill medium are one of polypropylene and polyethylene.

20. The container of claim 10 further comprising a cover positioned on upper edges of the side walls.

21. A container for holding product therein during shipment and providing ready access to the product, comprising:

a body having a base and side walls extending vertically upwardly from the base, the body having at least one open side;

a plurality of product bins disposed generally horizontally in the container body, the bins including open ends facing outwardly of an open side of the container body;

a flexible end wall closing an end of at least one of the bins opposite the open end, the flexible end wall operable to flex and expand the capacity of the bin when a product is placed therein.

22. The container of claim 21 wherein the plurality of bins each includes a flexible end wall.

23. The container of claim 21 wherein the flexible end wall is a cloth material.

* * * * *

UNITED STATES PATENT AND TRADEMARK OFFICE

CERTIFICATE OF CORRECTION

PATENT NO. : 5,725,118
DATED : March 10, 1998
INVENTOR(S) : Charles L. Slager, et al.

It is certified that error appears in the above-identified patent and that said Letters Patent is hereby corrected as shown below:

Claims
Claim 10,
Line 36, "two" should be deleted.

Claim 12, column 10,
Line 1, "produce" should read -- product --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*